United States Patent [19]

Hull

[11] Patent Number: 4,857,026

[45] Date of Patent: Aug. 15, 1989

[54] WATER SKI DEVICE

[76] Inventor: Ronald K. Hull, Rt. 4, Box 370, Harriman, Tenn. 37748

[21] Appl. No.: 192,967

[22] Filed: May 12, 1988

[51] Int. Cl.[4] ..... B63B 21/00

[52] U.S. Cl. ..... 441/65; 114/274

[58] Field of Search ..... 441/65, 66, 67, 68, 441/69, 74, 75, 79; 114/274, 253, 254

[56] References Cited

U.S. PATENT DOCUMENTS

| | | | |
|---|---|---|---|
| 1,713,570 | 5/1929 | Torrawa | 114/274 |
| 2,931,332 | 4/1960 | Hebrank | 114/274 |
| 3,182,341 | 5/1965 | Rieffle | 441/79 |
| 3,604,031 | 9/1971 | Cahill | 441/65 |
| 3,671,988 | 6/1972 | Newman | 441/65 |
| 3,688,723 | 9/1972 | Ulvesand et al. | 114/274 |
| 3,807,342 | 4/1974 | Turner | 441/65 |
| 4,571,195 | 2/1986 | Brooks | 441/74 |

FOREIGN PATENT DOCUMENTS

| | | | |
|---|---|---|---|
| 617831 | 2/1961 | Italy | 114/274 |

*Primary Examiner*—Sherman D. Basinger
*Assistant Examiner*—Stephen P. Avila

[57] ABSTRACT

A unique water ski device for use with a tow rope for allowing the rider to ride on, above or below the surface of the water, includes a riding platform rigidly affixed above a hydrofoil by a detachable bent pole, flanged on each end, so that it can be dismantled for easy transport and storage. The riding platform has a ski handle affixed by ropes for use by the rider as a balancing aid. The riding platform has a nonskid surface for the safety of the user. The length of the pole can be of various lengths up to and above 10 feet in length. The device is towed behind a boat by means of a two rope which is affixed to the forward end of the riding platform. The rider rides on the top of the riding platform in a standing position and by shifting his or her weight forward or backward controls the height of the device above, on or below the water surface.

3 Claims, 3 Drawing Sheets

WATER SKI DEVICE

This invention relates in general to improvements in water sports ski equipment and particularly to the unique combination of a riding platform and a hydrofoil which when towed behind a boat allows the rider to ride on, above, or below the surface of the water.

In the past, skis, surfboards, ski disks, and the like have provided a recreational means for a person to be towed at various speeds on the surface of the water. Previous art has included the use of various configurations which were designed to minimize balancing problems, to provide better device maneuverability for altering course, or to provide greater high speed stability. These structures addressed certain characteristic problems with water ski devices, but once underway, each was limited to riding only on the surface of the water.

The object of the present invention is to provide the rider with the means for controlling not only side to side movement of the device but also the elevation of the riding platform in relation to the surface of the water and concurrently to provide an entirely unique type of water device which can give the user an enjoyable and safe ride.

The water sports device herein takes the form of a surfboard like riding platform and a smaller lifting surface or hydrofoil rigidly mounted at opposite ends of a bent pole. The bottom hydrofoil acts as a lifting surface which when pulled through the water at the appropriate angle of attack can provide a controlled lifting force which can allow the upper platform to be ridden up to the length of the connecting pole above the water, several feet below the surface of the water, or any position in between. The upper platform acts as a riding platform and control station from which the rider can control the angle of attack of the hydrofoil by holding the handle and shifting his or her body weight forward or backward. Sideways movement of the device is similarly controlled by slight sideways shifts of the riders body weight.

It is a still further object of this invention to provide an inexpensive water sport device in which the riding platform and the hydrofoil are constructed of a rigid material such as wood, foam-filled, reinforced fiberglass, or molded plastic such that the device is structurally strong but light enough when assembled with the mounting pole to insure floatation. It is also an object of this invention to specify that the mounting pole can be disconnected from the riding platform and the hydrofoil to facilitate convenient transport or storage.

Further objects and advantages of my invention will become apparent from consideration of the drawings and ensuing description of it.

DRAWING FIGURES

Figure 4:
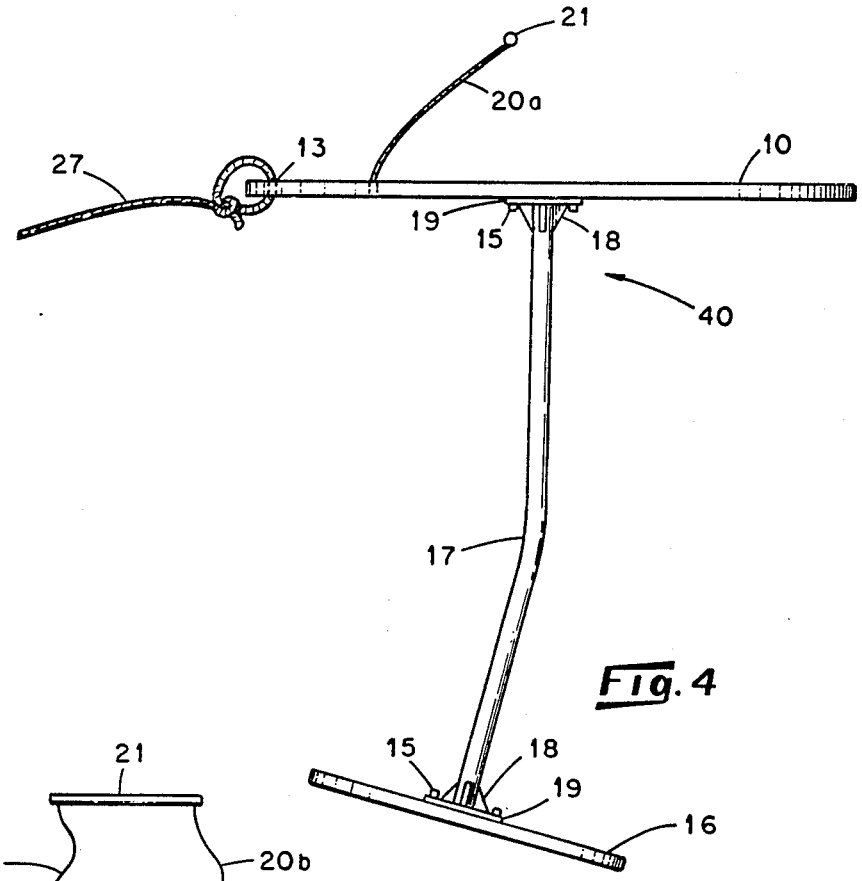
FIG. 4 is a side elevational view of the water ski device.
Figure 5:
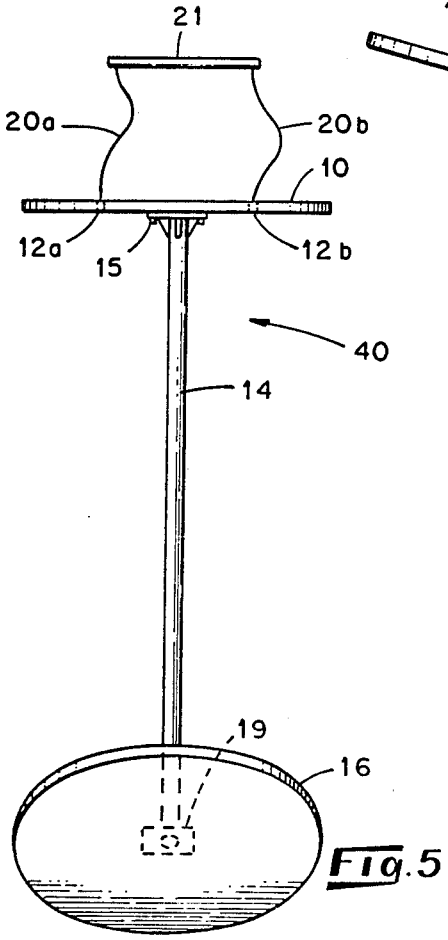
FIG. 5 is a front elevational view of the water ski device.
Figure 6:
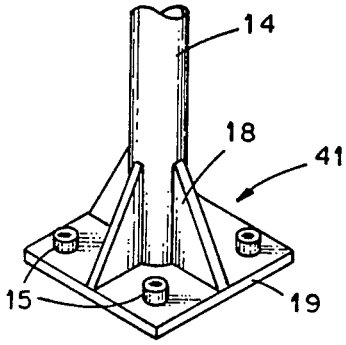
FIG. 6 is an enlarged perspective view of the flanged ends of the pole.

10 riding platform
11 non-skid surface
12 a&b rider handle holes
13 tow rope hole
14 pole
15 bolt
16 hydrofoil
17 bend in pole
18 gussets
19 plate
20 a&b handle ropes
21 ski handle
24 t nut
25 wood block
26 foam
27 tow rope
40 the device
41 flange With reference to the drawings, FIGS. 1, 3, 4, and 5, a water ski device produced in accordance with the subject invention is generally indicated by the reference numeral 40. The device 40 is comprised of a riding platform 10, a hydrofoil 16 and a interconnecting pole 14. The riding platform 10 is similar in shape to a conventional surfboard, although it is thinner and is uniform in thickness. The hydrofoil 16 is generally similar to a conventional ski disc, and is sized to provide sufficient lifting force for stable control at a slightly lower tow speed than required for regular water skis. The riding platform and hydrofoil, 10 and 16 respectively, may be formed of wood, foam filled, reinforced fiberglass, or molded plastic. The pole 14 is preferably formed of metal, and at its midpoint must have an angle 17 in the range of 150 to 170 degrees, as shown in FIG. 4. At each end of the pole 14, is a flange 41, which is comprised of a plate 19, and four gussets 18, which are all welded together as shown in FIG. 6.

Figure 2:
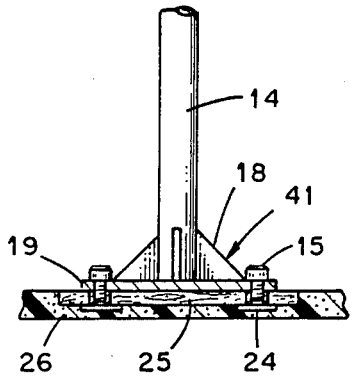
FIG. 2 is an enlarged sectional view taken along the line 4—4 of FIG. 4 and illustrating the method of attaching the pole to the riding platform and the hydrofoil.
Figure 3:
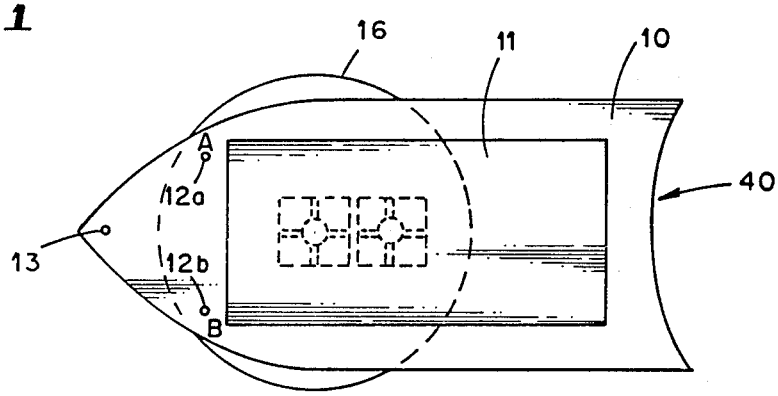
FIG. 3 is a top plan view of a water ski device produced in accordance with the subject invention.

Bolts 15 in the flange 41 at each end of the pole 14, are used to secure the pole 14 to the riding platform and the hydrofoil, 10 and 16 respectively on or about the center of each. Also the riding platform and the hydrofoil, 10 and 16 respectively are provided with threaded T-nuts 24 for receiving the threaded ends of the bolts 15, as shown in FIG. 2. In the embodiment described herein, the riding platform 10 and the hydrofoil 16 are formed of foam-filled 26 reinforced fiberglass with a supporting wood block.

Futhermore, alternate lengths can be provided for the pole 14 so as to provide for variable spacing between the riding platform 10 and the hydrofoil 16 as required by the skill of a particular user. If desired, the pole 14 can be of a telescoping tubular construction such that variable spacing may be achieved between the riding platform 10 and the hydrofoil 16 without substitution of alternate length poles (not shown).

Figure 1:
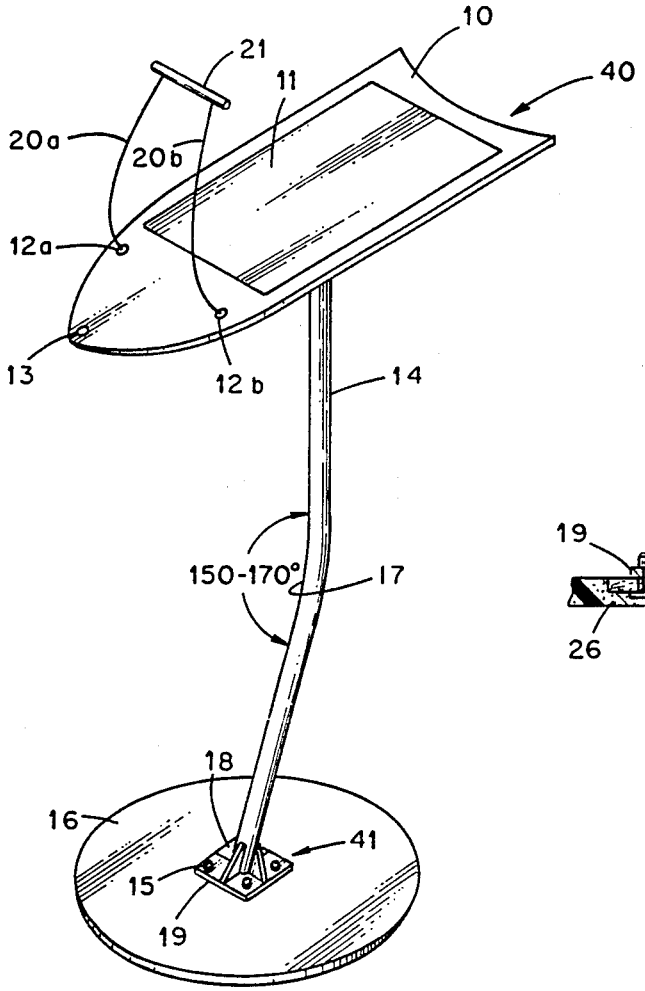
FIG. 1 shows a perspective front elevational view.

A rubber or carpet mat 11 is attached to the riding platform 10 by means of water proof glue to provide a suitable nonskid surface as shown in FIG. 1. Holes 12*a* and 12*b* are provided in the front of the riding platform 10 to facilitate the attaching of a rider handle 21, constructed of wood or sturdy plastic, via ropes 20*a* and 20*b*. One hole 13 is provided in the front center of the riding platform 10 to facilitate a tow rope 27, shown in FIG. 4. The ropes 20*a* and 20*b* may be adjusted in length as required by the need of a particular user.

It is not the intent of this presentation to specify the size or shape of the riding platform 10 or the hydrofoil 16 except that both would require a laterally symmetrical design to provide an even force distribution when pulled through the water and further that the hydrofoil should be sized to provide sufficient lifting force for stable control at a relatively low skiing speed.

Figure 7A:
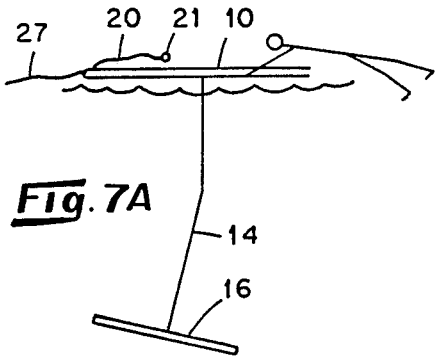
FIGS. 7A–7F are schematic pictorial series of views showing various positions of a skier atop a device constructed in accordance with the subject invention.

The operation of the water ski device is described as follows. The device 40 is first placed in the water, which must be deep enough to accommodate the length of the device 40. The skier secures the tow rope 27, which is connected to a prime mover vehicle such as a power boat, into hole 13 of the riding platform. The skier then positions the device 40 in a vertical position with the riding platform floating parallel to the surface of the water. The skier then clings to the floating riding platform 10 in a prone position (as illustrated in FIG. 7A), and as the prime mover boat starts to move the tow rope 27 is drawn up tight between the prime mover boat and the device 40. At this point, the tensile pull on the device 10 by the tow rope 27 is transmitted directly from the prime mover boat through the tow rope 27 to the device 40.

Figure 7B:
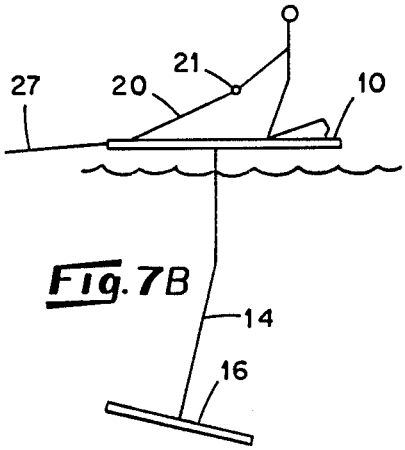
Figure 7C:
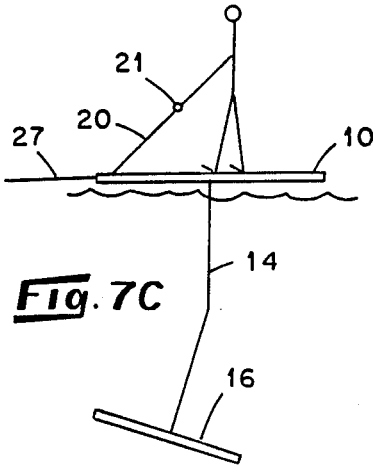
Figure 7D:
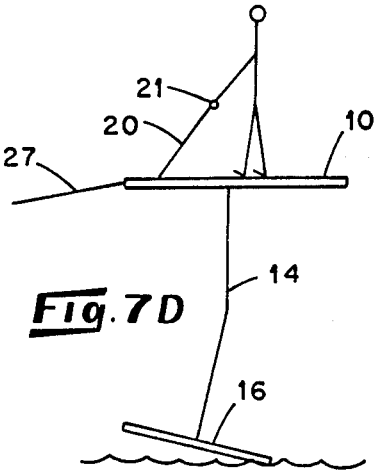
Figure 7E:
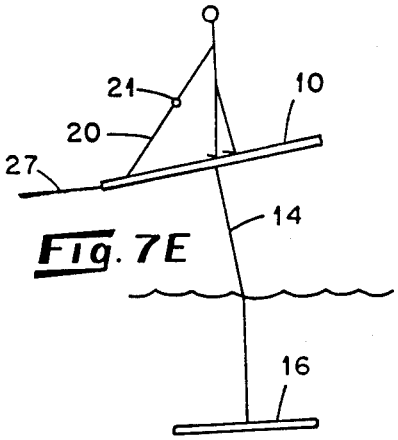
Figure 7F:
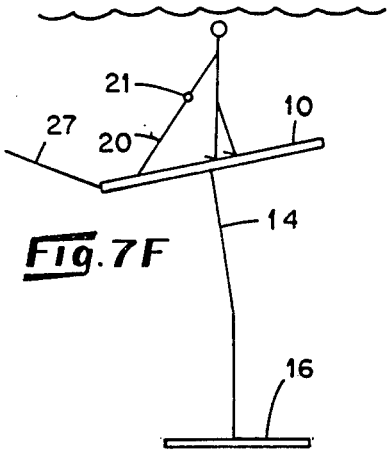

Almost as soon as the device 10 starts to move, the skier can grab the handle 21 and move to a crouched position (as in FIG. 7B). As speed increases, the skier may assume a standing position on the riding platform 10 (as shown in FIG. 7C). As the prime mover boat reaches a speed of 10 to 15 mph, the hydrofoil 16 climbs toward the water surface and pushes the riding platform 10 upwardly above the surface of the water (the exact height being determined by the length of the pole 14 as shown in FIG. 7D). The device 40 can be ridden continuously with the hydrofoil 16 planing on the surface of the water as shown in FIG. 7D, or the skier may shift his weight forward, reducing the angle of attack of the hydrofoil 16, thereby causing the hydrofoil 16 to sink back into the water and the riding platform to move lower toward the surface. (As illustrated in FIG. 7E). When the described sinking is effected, the skier may realize a free floating delicately balanced operation which is exciting and unlike that experienced on any other type of water vehicle. When the skier shifts his weight backwardly, increasing the angle of attack of the hydrofoil 16, the device 40 will once again ascend upwardly. As the skier obtains more skill he may ride the device 40 completely under the surface (As illustrated in FIG. 7F). The versatility of the device 40 allows it to be ridden up to the length of the connecting pole above the water surface, several feet below the water surface, or any position in between.

From the foregoing it should be appreciated that a novel and versatile water ski device has been described. It should be understood that various changes, alterations, and modifications may be effected in the details of construction and arrangements of the various elements, without departing from the spirit and scope of the instant invention, as defined in the appended claims.

What is claimed:

1. A towed water sports apparatus comprising a riding platform adapted to support a person above and below the surface thereof, a single planar hydrofoil member positioned beneath said riding platform in nonparallel alignment therewith, and detachable rigid means for attaching said hydrofoil member to the center of said riding platform whereby the person upon being towed through a body of water can, by shifting his weight, plane with the hydrofoil either on or below the water surface.

2. The water sports apparatus of claim 1 wherein the detachable rigid means for attaching said riding platform to said hydrofoil comprises a bent pole whereby the nonparallel alignment between said riding platform and said hydrofoil is maintained at 10–30 degrees.

3. The water sports apparatus of claim 1 wherein the means for attaching said riding platform to said hydrofoil comprises a detachable mounting pole flanged on a first end and flanged on a second end whereby said pole can be disconnected from the apparatus to facilitate convenient transport or storage.

* * * * *